United States Patent [19]

Walter

[11] Patent Number: 4,711,010

[45] Date of Patent: Dec. 8, 1987

[54] METHOD OF SEALING OFF THE VAPORIZATION CHAMBER OF A STEAM IRON

[75] Inventor: Robert Walter, Eppertshausen, Fed. Rep. of Germany

[73] Assignee: Rowenta-Werke GmbH, Offenbach am Main, Fed. Rep. of Germany

[21] Appl. No.: 861,783

[22] Filed: May 9, 1986

[30] Foreign Application Priority Data

May 11, 1985 [DE] Fed. Rep. of Germany ..... 3517018

[51] Int. Cl.[4] ..... B21D 53/00; B21K 29/00; B23P 15/26

[52] U.S. Cl. ..... 29/157 R; 29/445; 29/509; 29/521; 29/522 R; 38/77.8; 38/77.83

[58] Field of Search ..... 29/521, 509, 432, 445, 29/157 R, 522 R; 165/170; 219/245, 271; 38/77.1, 77.8, 77.83, 77.82, 77.5, 77.81, 85, 88

[56] References Cited

U.S. PATENT DOCUMENTS

| | | | |
|---|---|---|---|
| 1,671,647 | 5/1928 | McCarthy | 165/170 |
| 1,671,648 | 5/1928 | McCarthy | 165/170 |
| 2,746,183 | 5/1956 | Kistner | 38/77.83 |
| 2,975,928 | 3/1961 | Roovers | 29/521 UX |
| 3,000,093 | 9/1961 | Wredenfors | 29/521 X |
| 3,703,777 | 11/1972 | Knapp | 38/77.83 |
| 3,791,016 | 2/1974 | Eberhardt et al. | 29/521 X |
| 3,829,957 | 8/1974 | Pouch et al. | 29/522 R |
| 4,240,217 | 12/1980 | Schwob | 38/77.83 |

FOREIGN PATENT DOCUMENTS

| | | | |
|---|---|---|---|
| 2553750 | 6/1977 | Fed. Rep. of Germany | 38/85 |

*Primary Examiner*—Charlie T. Moon

[57] ABSTRACT

A method of sealing off a vaporization chamber provided in a soleplate of a steam iron by means of a cover is described. The vaporization chamber has an outer wall which has an upper edge remote from the bottom surface of the soleplate and having an upwardly opening continuous recess or groove provided therein. The method comprises placing the cover over the vaporization chamber in contact with the upper edge of the outer wall and applying high pressure to the cover, the cover material being forced into the recess to sealingly connect the cover to the soleplate before the pressure is released. There is no need for any additional sealing materials between the chamber and the cover and no need to screw or rivet the cover onto the soleplate.

1 Claim, 4 Drawing Figures

METHOD OF SEALING OFF THE VAPORIZATION CHAMBER OF A STEAM IRON

BACKGROUND OF THE INVENTION

The invention relates to a method of sealing off a vaporization chamber provided in a soleplate of a steam iron by means of a cover, and to a soleplate for use in such a method and to apparatus for carrying out the method.

In electric steam irons operating by the drip principle, the steam producing chamber in which water is converted from the liquid to the vapor phase and the associated steam channel system are provided in the electrically heated soleplate of the iron. The water drips out of the water tank into the steam producing chamber. The wet steam formed therein is subjected to superheating in steam channels. The steam emerges from the soleplate of the iron out of ports or steam escape holes leading from the steam channels. By additionally injecting water into the steam producing chamber, into separately provided chambers, or directly into the steam channels, extra steam can be generated in various types of irons. The entire steam producing chamber and steam channel areas of the soleplate of the iron in which steam is generated and superheating occurs is commonly referred to as the vaporization chamber.

The soleplate of the iron is generally die-cast from aluminum. After the soleplate of the iron has been formed, it is subjected to further working processes before the soleplate can be assembled with the other individual components to form a steam iron. One of the individual processes is the closing off of the vaporization chamber by means of a cover.

It is known to close off the vaporization chamber of a steam iron with a cover. For this purpose, the upper surface of the outer wall of the vaporization chamber of the soleplate, which will later be joined to the cover of the vaporization chamber, is normally subjected to a special surface machining. Then, before the cover of the chamber is put on, a special sealing composition is applied to the sealing surfaces of the walls of the vaporization chamber and the cover is connected to the soleplate by means of screws or rivets. These very laborious working steps are of particular importance since, for reasons of safety in operation, no steam must escape from the vaporization chamber during use of the steam iron except through the ports, whereby no moisture is allowed to penetrate into the interior of the iron.

SUMMARY OF THE INVENTION

According to the present invention there is provided a new and novel method of sealing off a vaporization chamber provided in a soleplate of a steam iron by means of a cover, the vaporization chamber having an outer wall which has an upper edge remote from the bottom surface of the soleplate of the iron with an upwardly-opening continuous recess or groove formed therein, the method comprising placing the cover over the vaporization chamber in contact with the upper edge of the outer wall and applying high pressure to the cover, the cover material being forced into the groove whereby the cover is sealingly connected to the soleplate before the pressure is released.

At least in a preferred method it is possible to connect the cover of the vaporization chamber to the wall thereof without any fine surface machining of the grooved contact surface and without any additional sealing means, while insuring that adequate sealing is obtained to prevent steam and hence moisture from penetrating into the interior of the iron during subsequent use.

In general, the yield limit of the material of the chamber cover will be lower than the yield limit of the material of the soleplate of the iron, and the pressure applied to the cover will generally be above the yield limit of the material of the cover but below the yield limit of the material of the soleplate. In such an arrangement as a result of the yield limit of the cover material being exceeded when the cover and the soleplate are pressed together, some of the cover material is displaced into the contours of the groove in the chamber wall and held in this position. Only now are the chamber cover and the soleplate joined together by means other than screws or rivets. Then the pressure applied to the cover by a press can be released and the soleplate/cover subassembly can be removed from the press. When the vaporization chamber of a steam iron is closed off using such a method there is no need for any additional sealing means such as silicon rubber, for example. The enlargement of the contact surface between the cover and the soleplate and the absence of any additional sealing materials can insure a considerably improved heat transfer between the soleplate and the cover. This in turn results in a significant increase in the efficiency of the vaporization chamber when converting water flowing out of the water tank into the vaporization chamber from a liquid state to a vapor state.

The invention also provides a soleplate for use in the methods disclosed herein, wherein the outer wall enclosing the vaporization chamber extends perpendicularly to the bottom surface of the soleplate, and the upper edge of the outer wall has a continuous groove-like recess.

If the materials of the cover and the soleplate are selected to have the flow properties discussed above, then the cover material can flow into the groove-like recess during the compression and after the cover and soleplate have been joined together a pressure-tight joint is obtained between the cover and the wall of the vaporization chamber.

It is particularly advantageous if the groove-like recess in the vaporization chamber wall has a trapezoidal cross section, widening out towards the bottom surface of the soleplate. During the preferred method, some of the cover material which has been stressed beyond its flow limit penetrates into the groove-like recess and remains therein. With the groove-like recess in the trapezoidal dovetail form, surprisingly, there is no need for any further connection between the cover and the soleplate of the iron by additionally screwing or riveting these two parts together.

It has proved particularly advantageous to carry out the method according to the invention by using apparatus comprising a press having a die for applying high pressure to the cover, the die having a pressing surface projecting downwardly from the base of the die and shaped to correspond to the upper edge of the outer wall of the vaporization chamber, and the width of the pressing surface being equal to or greater than the width of the opening of the groove-like recess formed in said upper edge of the outer wall. In this way, it is possible to insure that the pressing surface of the die does not exert any shearing action on the cover, but that the cover material, stressed beyond its yield limit, flows into the groove-like recess and fills the recess, so that it is permanently deformed when the pressure is released.

Preferably, the base of the die has contour surfaces projecting downwardly therefrom, the contour surfaces being shaped to correspond to further walls of the soleplate, which walls extend perpendicularly to the bottom surface of the soleplate and define steam channels and the vaporization chamber, the width of the contour surfaces being equal to or greater than the spacing of said further walls of the soleplate. In this way, the steam producing chamber and the steam channels connected thereto in the cover area are kept separate from one another in a pressure tight manner so that the steam produced in the steam producing chamber is forced to flow through the entire length of the steam chanels. This is particularly important if the steam and extra steam are produced in two separate areas and supplied to the ports of the soleplate through two separate channel systems. In this way, steam short circuits between the two steam systems or from the steam producing chamber to the steam channels are prevented in an absolutely reliable manner.

DESCRIPTION OF THE PREFERRED EMBODIMENT

Figure 1:
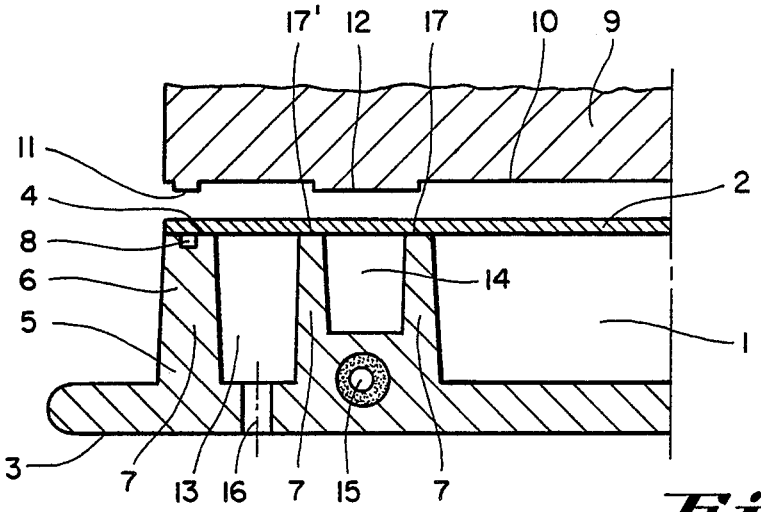
FIG. 1 is a partial vertical cross-sectional view through the soleplate of a steam iron with a cover placed on the vaporization chamber before the vaporization chamber is sealingly closed off.
Figure 2:
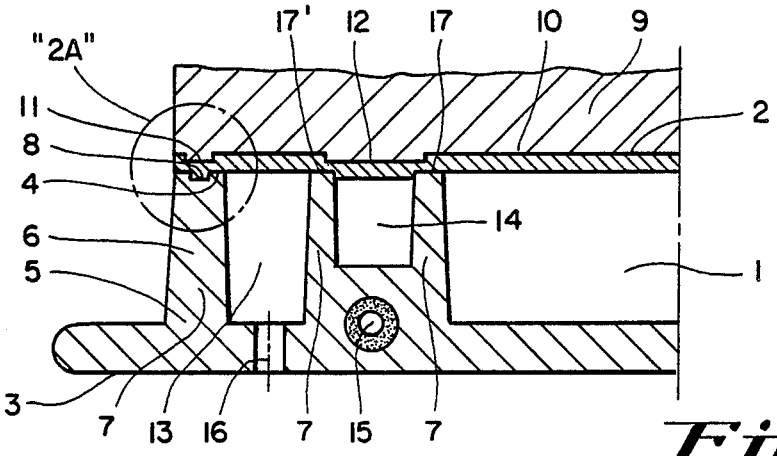
FIG. 2 is a partial vertical cross-sectional view similar to FIG. 1 with the vaporization chamber sealingly closed off by the cover after the sealing process of the present invention.
Figure 2A:
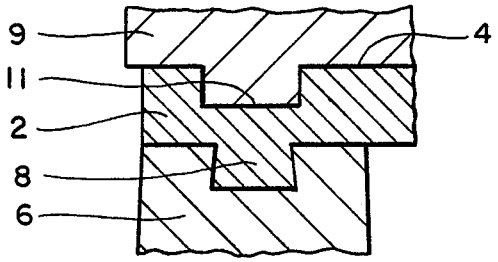
FIG. 2A is an enlarged detail view of the area circled in FIG. 2.
Figure 3:
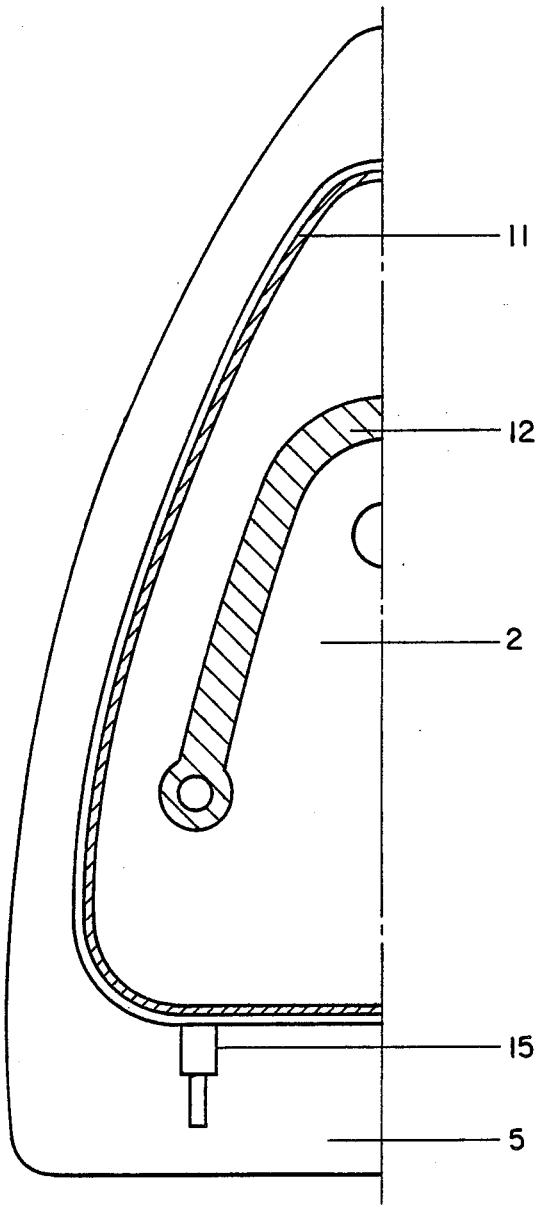
FIG. 3 is a partial top plan view of the soleplate/-cover sub-assembly resulting from the assembly process of the present invention with the view being taken along the plane of the upper surface of the cover 2 and through the pressing surface 11 and contour surface 12 of the die 9 in FIG. 2.

A vaporization chamber comprises a steam producing chamber 1 and steam channels 13, 14 arranged in a soleplate 5 of the iron, which is not fully shown. The steam channels 13, 14 are defined by upright walls 7 and the steam channel 14 is used to superheat the steam. Below the steam channel 14, an electrical tubular heating element 15 is cast into the soleplate 5 of the iron. During steam ironing, the steam escapes out of the steam channel 13 via a steam escape hole or port 16 to a bottom surface 3 of the soleplate 5. An upwardly opening continuous recess or groove 8 is provided in an upper edge surface 4 of an outer wall 6 of the soleplate 5. In order to achieve a steam-tight seal of the vaporization chamber with a cover 2, it is particularly advantageous if the recess 8 is provided along the entire peripheral upper edge 4 of the outer wall 6. It is also possible to provide similar upwardly opening recesses in the upper edges 17, 17' of the walls 7 defining the steam channel 14, thereby achieving an additional sealing action. The recess or groove 8 may take various spatial forms. The recess 8 shown by way of example has a trapezoidal dovetail cross-section, which results in a particular sealing and connecting action between the cover 2 and the soleplate 5 of the iron, as discussed hereinbefore.

A die 9 of a press is arranged over the cover 2. A pressing surface 11 and a contour surface 12 project downwardly from a base 10 of the die 9.

When the preferred method is carried out, first of all, the cover 2 is placed on the soleplate 5 of the iron and then the die 9 of the press is lowered. During the pressing operation, the pressure of the press first of all acts only in the region of the pressing surface 11 and the contour surface 12 on the cover 2. It is particularly important that the widths of the pressing surface 11 and the contour surface 12 are respectively equal to or greater than the widths of the open top portions of the groove-like recess 8 and of the steam channels 13, 14. As a result of the high contact

What is claimed is:

1. A method of sealing off outer and inner vaporization chambers provided in a metal sole plate of a steam iron by means of a metal cover, the outer vaporization chamber having an outer peripheral wall with an upper edge surrounding and spaced from the inner chamber defined by inner and outer walls, the method including forming a continuous groove the upper edge of in said outer peripheral wall of trapezoidal dovetail cross-sectional shape opening at said upper edge, choosing a material for said metal cover having a lower yield limit than the yield limit for the material of said metal sole plate, placing said metal cover over said vaporization chambers, applying pressure to said metal cover to force portions thereof into said continuous groove to fill said groove and force portions thereof into pressed engagement between said inner and outer walls of said inner chamber without substantially deforming said sole plate during said pressing.

* * * * *